US007729819B2

(12) United States Patent
Rajaram

(10) Patent No.: US 7,729,819 B2
(45) Date of Patent: Jun. 1, 2010

(54) TRACK IDENTIFICATION SYSTEM

(75) Inventor: Bojji Rajaram, Navi Mumbai (IN)

(73) Assignee: Konkan Railway Corporation Ltd., Navi Mumbai, Maharashtra (IN)

( * ) Notice: Subject to any disclaimer, the term of this patent is extended or adjusted under 35 U.S.C. 154(b) by 87 days.

(21) Appl. No.: 10/939,056

(22) Filed: Sep. 10, 2004

(65) Prior Publication Data

US 2006/0030978 A1 Feb. 9, 2006

(30) Foreign Application Priority Data

May 8, 2004 (IN) ..... 843/MUM/2004

(51) Int. Cl.
*G06F 17/00* (2006.01)

(52) U.S. Cl. ..... 701/19; 701/213; 701/301

(58) Field of Classification Search ..... 701/19, 701/213, 301; 246/1 C, 26, 98, 162, 176, 246/220, 226, 239, 415 R, 476, 182 AA, 246/182 AB; 104/130.01; *G06F 17/00*
See application file for complete search history.

(56) References Cited

U.S. PATENT DOCUMENTS

| | | | | |
|---|---|---|---|---|
| 5,791,063 | A * | 8/1998 | Kesler et al. | 33/651 |
| 5,867,404 | A * | 2/1999 | Bryan | 714/724 |
| 6,119,056 | A * | 9/2000 | Beike | 701/19 |
| 6,371,418 | B1 * | 4/2002 | Oswald et al. | 246/415 R |
| 6,373,403 | B1 * | 4/2002 | Korver et al. | 340/988 |
| 6,454,221 | B1 * | 9/2002 | Bonfigli | 246/415 R |
| 6,480,766 | B2 * | 11/2002 | Hawthorne et al. | 701/19 |
| 6,526,339 | B1 * | 2/2003 | Herzog et al. | 701/19 |
| 6,824,110 | B2 * | 11/2004 | Kane et al. | 246/293 |
| 6,865,454 | B2 * | 3/2005 | Kane et al. | 701/19 |
| 6,957,131 | B2 * | 10/2005 | Kane et al. | 701/19 |
| 7,036,774 | B2 * | 5/2006 | Kane et al. | 246/167 R |
| 7,164,975 | B2 * | 1/2007 | Bidaud | 701/19 |
| 2002/0096604 | A1 * | 7/2002 | Hager et al. | 246/220 |
| 2004/0015275 | A1 * | 1/2004 | Herzog et al. | 701/19 |
| 2004/0138788 | A1 * | 7/2004 | Herzog et al. | 701/19 |

FOREIGN PATENT DOCUMENTS

| | | | |
|---|---|---|---|
| FR | 2674808 | A1 * | 10/1992 |
| JP | 10048319 | A * | 2/1998 |
| JP | 2002107395 | A * | 4/2002 |
| JP | 2003085699 | A * | 3/2003 |

* cited by examiner

*Primary Examiner*—Tuan C To
(74) *Attorney, Agent, or Firm*—Frishauf, Holtz, Goodman & Chick, P.C.; Robert P. Michal

(57) ABSTRACT

A track identification system for a plurality of locomotives moving on defined plurality of tracks of a railway network wherein the system consists of on board computers with track data and identifiable switching locations data and the parameters of movement of the locomotives along the said tracks, the computers receiving reference location signals of the locomotive from a global positioning system and different geographical locations of the locomotives and digitally map the determined geographical locations on the stored route and track data, the computers continuously monitoring the movement of the locomotives with reference to specific parameters to compute the angular velocity change profile to determine switching actions at the said switching locations and generate signals relative to the angular change profile relating to switching actions at the switching locations to determine the tracks on which the movement of each of the locomotives is occurring and the velocity of such movement.

7 Claims, 4 Drawing Sheets

TRACK IDENTIFICATION SYSTEM

TECHNICAL FIELD

This invention relates to locomotives.

In particular, this invention relates to systems for managing movement of locomotives in a railway network.

Still particularly, this invention envisages a novel track identification system for use with railway management systems and collision avoidance devices for locomotives.

BACKGROUND OF THE INVENTION

Locomotives are widely used for transportation. Locomotives run on designated tracks. The movement along designated tracks in a defined route is governed by a movement controller generally remotely located from the path of travel. Physically, the movement of locomotives through stations is controlled by a signal system which is well known in the art and is beyond the scope of this invention. However, in mid sections even this is not available and the driver has to rely on eye sight to prevent accidents. However, driver error can cause a serious accident. Again, accidents involving trains and at level crossing gates frequently involve loss of property and life. Accidents, involving locomotives, include locomotives colliding with each other, also referred to as a head on collision. Similarly, there is a possibility of a side collision, rear end collision, collision between locomotives and road vehicles such as cars, carts, animal or persons at manned (interlocked or non-inter locked) as well as unmanned level crossing (LC) gates also referred to as 'grade' crossings. Such accidents may be because of mistakes committed by road users or of the railway staff. Mishaps occur due to the train crew becoming inattentive for to any reason. These accidents may also be as a result of system failure or due to human error. Such incidents caused by human error are not generally preventable with the help of currently available technology. Sophisticated technology such as radar is available, but this is very expensive.

Global Positioning satellites and global positioning systems [GPS] running on them are well known. The GPS is a constellation of satellites traveling in pre determined circular 12 hour orbits approximately 10,900 nautical miles distributed around the earth in three inclined planes at about of degrees from the equator. These satellites transmit location and time reference signals in PRN [pseudo random number] code and triangulate position coordinates. These systems define the position of an object with respect to the center of the earth with respect to its latitude and longitude and altitude, by means of a reference signal receiving device fitted on the object. The signals can be received by GPS receivers, typically having receiving/transmitting antennas. Typical receivers operate in three modes: signal acquisition, signal tracking and position fixing mode. Current generation GPS receivers for civilian use using differential and other techniques are able to pin point an object to which it is fitted with an accuracy of around 5 meters.

Track identification is an integral requirement for automatic railway network management systems. Hitherto, track identification and allocation is set at the beginning a rail journey and is inputted by the rail crew manually at switching locations enroute. This lack of an automatic accurate track identification system has also been the main reason for the lack of a fool proof collision avoidance device. Generally, the GPS location coordinates are not adequate to automatically determine track ID of locomotives moving on assigned tracks. Hitherto, therefore, it is not possible to use the GPS for track identification.

DESCRIPTION OF PRIOR ART

Several methods and apparatus have been proposed that will detect and automatically avoid train collisions. The following patents represent proposed solutions to the long standing problem of vehicular collisions, some of them catastrophic, including collisions between locomotives.

U.S. Pat. No. 2,762,913 discloses a railway train proximity warning system. The disclosed system uses a transmitter and a receiver fitted at each end of a train for sending and receiving coded signals. Control means are also provided to disable each of the receivers during periods of radiation from the adjacent transmitter.

U.S. Pat. No. 2,783,369 discloses a radio transmitting and receiving signal system for use in a railway system to minimize accidents, the exact location of a train to be determined because the signal will vary linearly with the distance traveled and also indicate by its frequency the exact location of the train.

U.S. Pat. No. 3,365,572 discloses an automatic collision prevention, alarm and control system for use by trains using continuous beam lasers at each end of the train that are projected ahead and behind the train. Photo electric cell detectors are used to provide an audible or visual warning to the engineer and, at the same time, automatic control circuits may be operated to effect an emergency brake application or the automatic closing of the throttle. This system may give false indications and thereby cause needless alarm or control.

U.S. Pat. No. 4,473,787 discloses a system for maintaining the spacing of trains or other track bound vehicles. It utilizes a light emitter, operating with modulated light and radiating uniformly and a light receiver to reduce the speed of the vehicle with increasingly received light intensity.

U.S. Pat. No. 4,701,760 discloses a method for monitoring vehicles from a central station by obtaining the approximate coordinate of the vehicle from signals transmitted by stations of the world omega network, using vehicle carried receivers. The approximate coordinates are corrected by reception and processing means connected to a fixed radiogoniometry beacons. Processing means connected to the vehicle-carried receiver supply the real coordinates of the vehicle to a vehicle-carried transmitter. The actual coordinates are transmitted in actual form to a receiver at a central station. Alarms on board the vehicle can be transmitted to the station.

U.S. Pat. No. 4,897,661 discloses a method and apparatus for determining the position of a vehicle with a system utilizing a transponder in each vehicle that transmits a signal responsive to an interrogation signal to a ground station through two or more satellites. The position of the vehicle is determined from the propagation time differences of the response signals received from the satellite.

U.S. Pat. No. 4,942,395 disclosed a warning device using MHZ radio frequency. A signal generator is mounted on the locomotive which is able to send signals to sympathetic receivers mounted on crossings and in vehicles to alert motorists of an oncoming train at a 'live crossing'.

U.S. Pat. No. 5,068,654 discloses a collision avoidance system that addresses the problem involved where there is a large number of vehicles in the same general area. Each vehicle is equipped with a collision avoidance transponder for transmitting and receiving data from the other vehicles. A central reference time signal generator is provided in a neutral position in order to transmit a periodic reference timing signal for reception at the transponders. Upon the transponder receiving the reference timing signal, it subsequently transmits information data relating to that vehicle for reception by the other vehicles. Each transponder is allocated a specific time slot or period which is unique to that vehicle for transmitting the information data.

U.S. Pat. No. 5,210,534 discloses an encoding method for anti-collision systems for sea navigation. Here, a transmitter aboard a ship transmits its geographical coordinates, speed and course, as well as an identification code.

U.S. Pat. No. 5,307,074 is another collision avoidance system for sea navigation. A transmitter aboard ship transmits its geographic coordinates, course and speed and a display exposes similar data from other ships. The received data are displayed, mostly in the form of symbols on the panoramic screen of the display device.

U.S. Pat. No. 5,574,469 explains a method for improved collision avoidance of two locomotives by periodically receiving on each locomotive digitally encoded data to determine its geographical location, speed and direction of travel by means of an onboard global positioning system receiver. However, this method only tells the Engineer/Driver that another train is within 7-mile range. Human intervention is required to negate the penalty brake if the other train is on different track. Also this is not suitable for yard/terminal yards where it has to be switched off manually. Even in this disclosure there is no means for accurately identifying the actual track on which the locomotive is moving.

European Patent No EP0952062 explains about mechanical device mounted on each vehicle of the train to reduce the impact of collision.

U.S. Pat. No. 6,163,755 provides a video camera in front of the engine of the locomotive and a video processing circuit which continuously processes images received by the camera. In case an obstacle is detected, the processor provides signals by which brakes can be applied manually or automatically.

U.S. Pat. No. 6,417,765 provides an anti-collision and anti derailment safety system consisting of a self propelled trolley to precede a train. The trolley has sensors to pick up anomalies on the track in front and relay this information to the train. The trolley is piloted from the train. However such a trolley is restricted by one time use in the case of an accident.

U.S. Pat. No. 6,580,976 discloses a method for increasing efficiency of operation of trains includes operating a plurality of trains as a moving sequence and regulating distances between the trains to eliminate distances in excess of safe minimum distances between the trains. Distance between a preceding train and a following train is regulated by varying speed of the following train to minimize an excess distance between the two trains.

U.S. Pat. No. 6,631,322 provides a method and system for pacing a locomotive along a path of travel which includes determining geographical location, displaying an icon representative of the geographical location, determining an optimal position, displaying a pace icon representative of the optimal position, and operating the locomotive to maintain a position icon displayed on the operator pace display substantially coincident with the pace icon displayed on the operator pace display. The system includes at least one on-board tracking system configured to determine the geographical location, at least one on-board computer configured to determine a display position of a pace icon, and at least one on-board operator pace display configured to display the pace icon at a position determined by the on-board computer, the operator pace display further configured to display the vehicle position, as determined by the on-board computer, relative to the pace icon.

OBJECTS OF THIS INVENTION

It is a particular object of the invention to provide a system for providing locomotive movement identification in real time and an advanced warning of the presence of an obstacle or another train on a section of rail track, thus permitting suitable preventive or avoidance action to be taken so as to avoid a locomotive colliding with another locomotive or an obstacle.

It is a further object of this invention that the collision avoidance action can be taken automatically, preferably without human intervention with an overriding mechanism for manual control.

Yet another object of this invention is that the automatic avoidance that can be taken to prevent collision occurs only in absolute necessary cases and not routinely, thereby preventing needless operation of the action when not needed.

An object of this invention is to provide a track identification system using the existing GPS for automatic track identification of moving locomotives in real time.

Another object of this invention is to provide the basis for an automatic collision warning and avoidance system for locomotives moving on tracks.

Yet another object of this invention is to provide a system for automatically updating track changes accurately at switching locations, such updating being made possible without human intervention.

Still another object of this invention is to accurately identify the track on which two or more locomotives are moving or at least one of them is moving relative to the other, thereby ensuring that if two locomotives are moving on a track identified to be the same then collision avoidance measures can be implemented simultaneously in one or the other locomotive.

BRIEF SUMMARY OF THE INVENTION

With this and other objects in mind, according to this invention there is provided a track identification system for a plurality of locomotives moving on defined plurality of tracks, said tracks having uniquely identifiable switching locations where said locomotives can switch movement from one track to movement on to one or more other tracks, said tracks passing through a railway network consisting of locomotives, stationary structures such as stations, crossings, yards, said system consisting of on board computers fitted to each of the locomotives, said on board computers having storage means to eraseably store digitally encoded information of at least a portion of the route and track data relating to the said plurality of tracks, each of said uniquely identifiable switching locations, and the parameters of movement of the locomotives along the said tracks, said computers having processors programmed to receive reference location signals of the locomotive from a global positioning system and thereby determine the precise geographical locations of the locomotives, said computers further programmed to digitally map at least a portion of the determined geographical locations on the stored route and track data, and to continuously monitor the movement of the locomotives with reference to parameters such as their location coordinates, velocity and angular change profile, and further having programming means to compute the angular change profile to determine switching actions at the said switching locations and programmed signal generator means operable by the said processing means to generate signals relative to the angular change profile relating to switching actions at the switching locations thereby determining the tracks on which the movement of each of the locomotives is occurring and the velocity of such movement.

Particularly, the programming means includes means to determine a first difference angular change coupled with second difference angular change to determine switching actions at the said switching locations.

Typically, the system includes GPS antennas for receiving reference location signals from a GPS satellite said antennas cooperating with the on board computers.

In accordance with a preferred embodiment of this invention the on board computers are powered through power sources independent of the power sources of the locomotives.

In accordance with a preferred embodiment of this invention the on board computers have display means in which the determined track and the velocity of locomotive is displayed.

In accordance with a preferred embodiment of this invention the on board computers are equipped with data storage means for storing the track changes at the switching locations.

In accordance with a preferred embodiment of this invention the system includes transmitting means for transmitting the track changes to other locomotives and to stationary structures associated with railway network.

Typically, the device fitted in the locomotives for taking preventive or avoidance action is at least any one of the following devices a braking system for retarding the speeds of running locomotives, a display device for displaying information and/or warning messages and data, visual alarms, audio warning devices.

Typically, the device fitted in the stationary structures for taking preventive or avoidance action is at least any one of the following devices, a display device for displaying information and/or warning messages and data, visual alarms, audio warning devices.

Typically, at least one antenna configured to receive signals from the Global Positioning System is fitted on each of the locomotives, typically at the front of the locomotive on the roof top.

Typically, the locomotives and the stationary structures are fitted with receiver and transmitting devices, preferably having a range of 3 kilometers or more, typically to match with the predetermined braking distances.

In accordance with a preferred embodiment of the invention, the on board computers in the locomotives have an independent power supply.

In accordance with a preferred embodiment of the invention, the GPS receiver device fitted in the locomotives and in the stationary structures has an independent power supply.

In accordance with a preferred embodiment of the invention, the receiver and transmitting devices are fitted with whip type antennas.

In accordance with an embodiment of the invention the on board computers in the locomotives are provided with angular profile computing means which includes knowledge embedded intelligent devices.

BRIEF DESCRIPTION OF THE SEVERAL VIEWS OF THE DRAWINGS

The invention will now be described with reference to the accompanying drawings, in which

Referring to FIG. 1 of the drawings there is disclosed the theory on the basis of which the present invention has been developed.

DETAILED DESCRIPTION OF THE INVENTION

Figure 1:
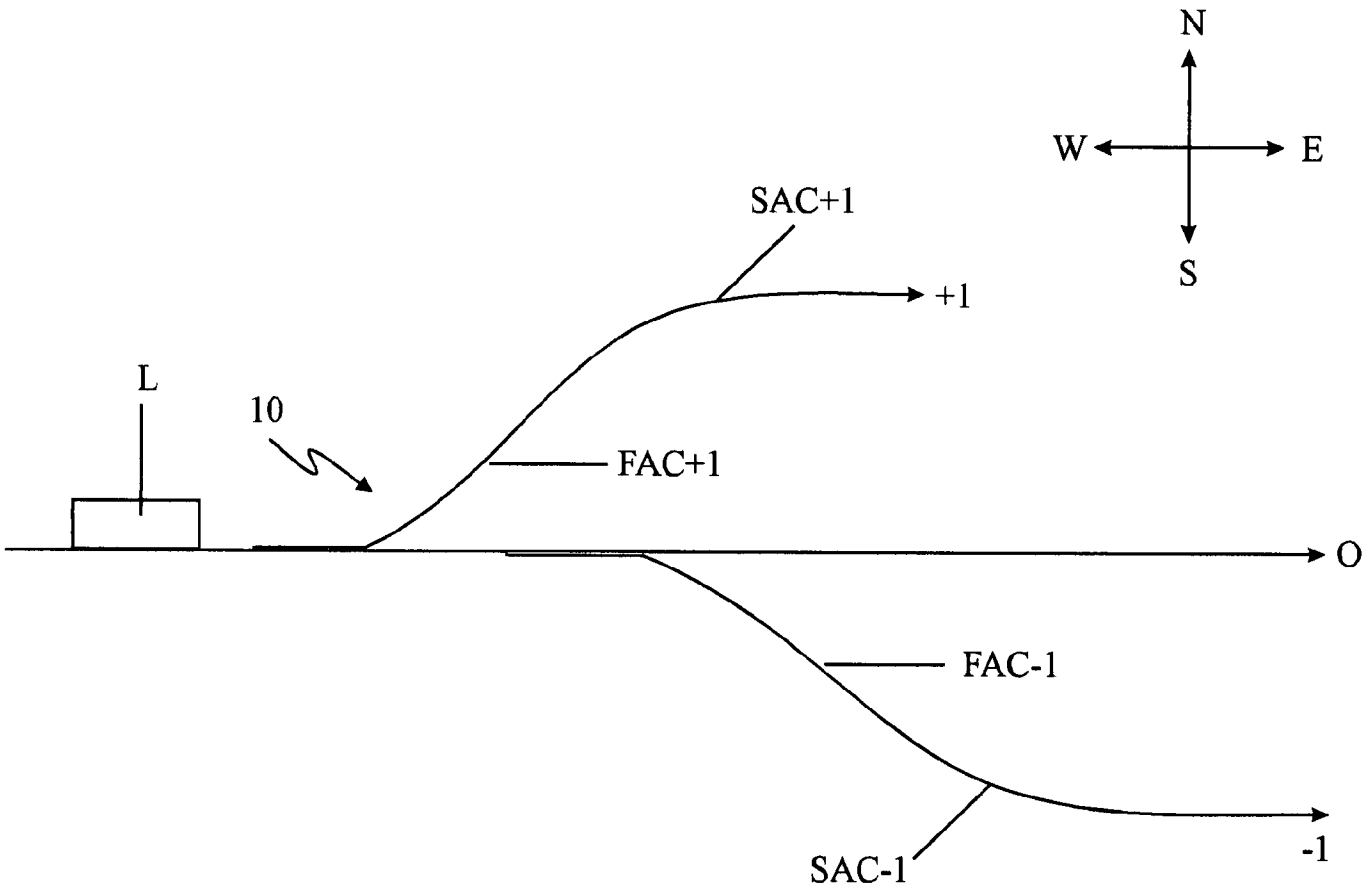
FIG. 1 shows a representation explaining the theory for calculation of the angular profile signature of the method and apparatus of this invention.

In FIG. 1, what is generally indicated is a switching location 10 at which a locomotive can change track. Assuming the locomotive is traveling in a relative West→East direction on track 0. At the switching location 10, the locomotive L is can be made to travel at the Exit in 3 possible ways: Either it exits on track 0 it self, which means the track is unchanged or it can exit on track +1 [plus 1], or −1 [minus 1]. These track identification numbers have been arbitrarily provided for the purposes of explaining the theory of this invention. These numbers are with reference to the original track being designated as 0 and therefore can be easily understood as being provided arbitrarily. However as can be seen with reference to the direction symbols movement on tracks +1 and will require a shift in the Northernly direction, whereas movement along track −1 will require a shift in the Southernly direction. In the case of natural curves in the existing track such shift in the Northernly or Southernly direction may happen in track 0 without change in the track as is seen in FIG. 1*a* where movement along path 0N is a movement towards the north without change of track whereas movement along section of track 0S is movement towards the South without change in track.

The situation involving a track change as seen in FIG. 1 involves two angular changes first angular changes FAC +1 and FAC −1 immediately followed by second angular changes respectively SAC +1, and SAC −1 in respect of movements on tracks +1, and −1. SAC +1, and SAC −1 lead to the locomotive L moving in the same direction but with shifts to the North or South respectively.

There may be a margin of error in GPS Lat Long readings for the locomotive L moving on tracks O, +1, or −1, but the readings of FAC+1 followed by SAC+1 or SAC −1 can be read accurately as there as deviations with respect to the true North. It is this principle that is used in this invention for determining a change in track from track 0 and therefore very accurately predict the track automatically.

Figure 2:
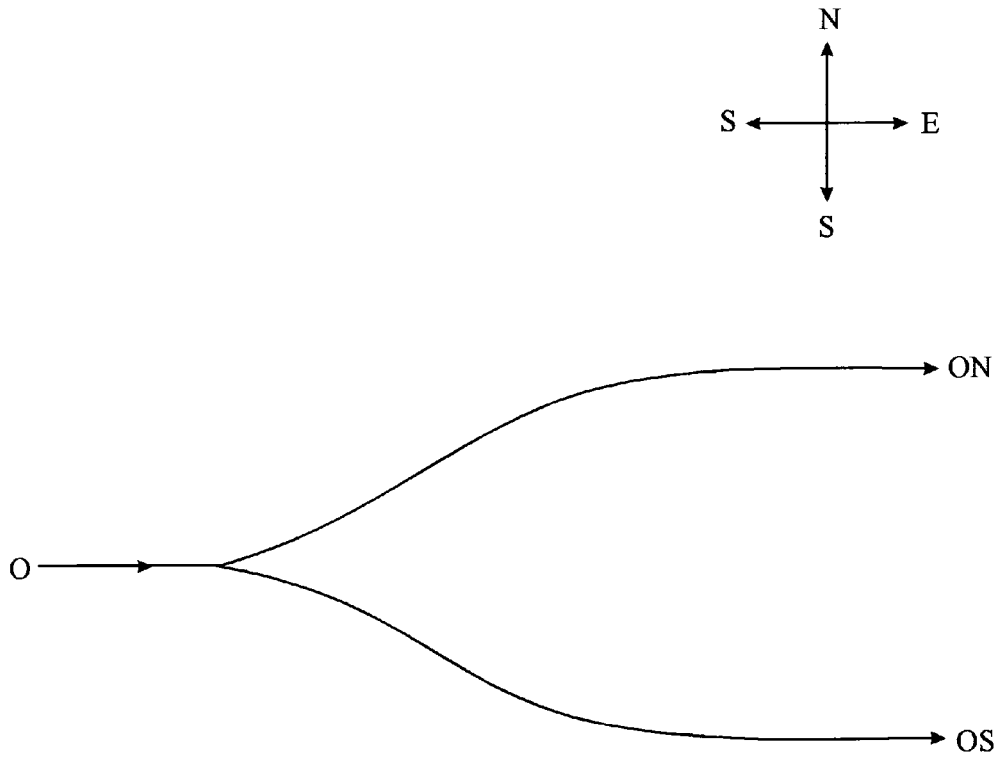
FIG. 2 is a block diagram of the on board computing means in a locomotive illustrating the various blocks by the track identification in accordance with this invention takes place.

FIG. 2 is a block diagram of the blocks that can be provided for the track identification system in accordance with this invention.

Figure 3:
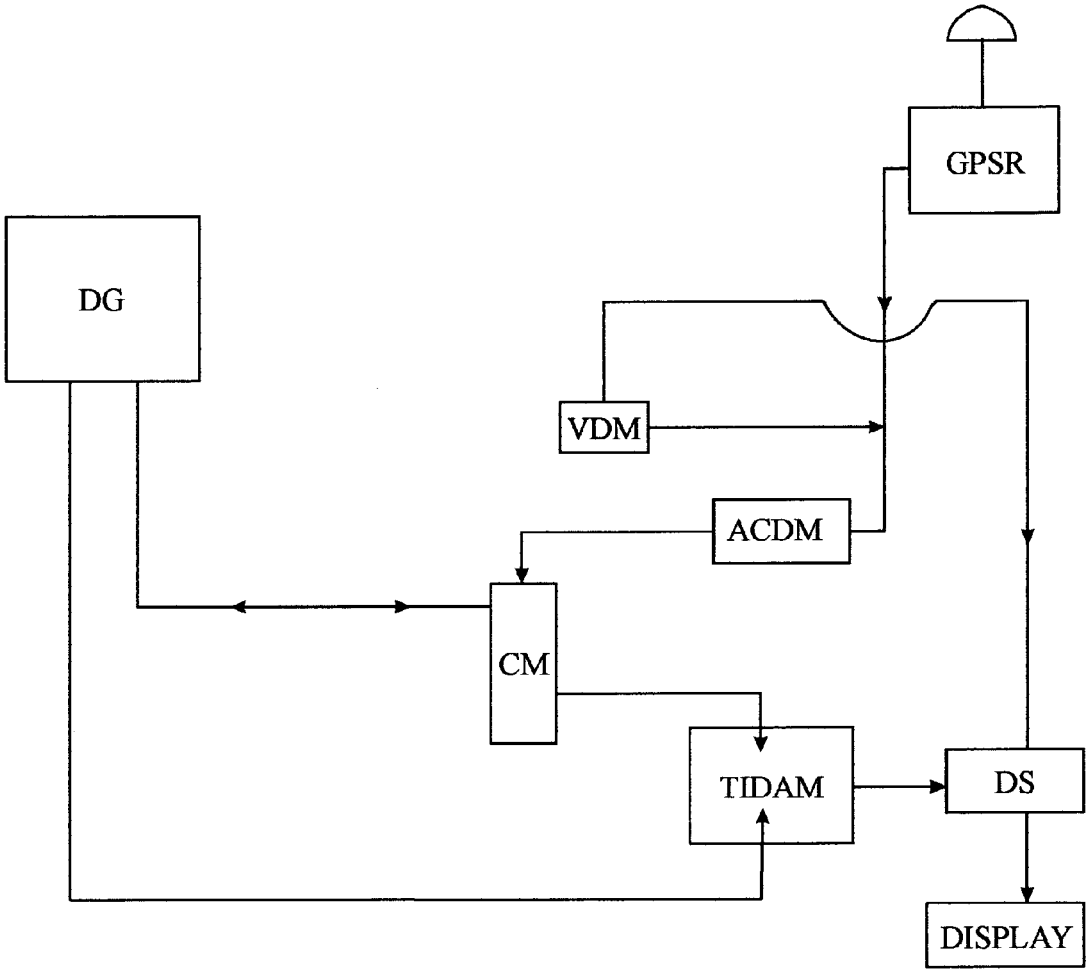
FIG. 3 is a flow chart involved in the track identification method in accordance with this invention.

In FIG. 3, the central processing unit of the on board computer in the locomotive is connected to a global positioning system receiver GPSR. Apart from various other inputs received from the receiver GPSR two important inputs are referred to for the purposes of this invention. The block ACDM receives the input that is the lat long positions with reference to true North, speed and time stamp and this is serially stored in the memory of the on board computer DG and is programmed to determine angular changes of the locomotive. The angular changes are compared on a continuous basis. These angular changes are fed to the comparator means CM on a continuous basis to define a curve of points plotted graphically at the same time the processing unit draws data from the data base DG, which may typically be a RAM on information relating to the route map based on the lat long positions received from the GPSR. The route map information and particularly of the uniquely identifiable switching locations along the route are fed into the comparator means. The comparator means CM may typically be a disk on chip memory storage device means in the central processing means of the on board computer. The information received from the angular change determining means ACDM is superimposed on the route map information to form an angular change table and the plotted graphical curve on the basis of the actual information received from the GPSR is matched with the stored curve received from the information pre stored in the database DG depending upon which curve is matched the information of any changes and switching location information are fed to a track identification assignment means TIDAM. The track identification assignment means TIDAM dynamically receives information of the currently identified track directly from the data base DG. The information received from the comparator means is then used either to retain the existing track ID or to change the track ID as the case may be at the exit of the switching location. The plotted curve information is also concurrently received in the velocity determining means VM which determines the rate at which the changes are taking place and the direction, thereby determining the actual velocity of the locomotive. The track change information along with the details from the velocity determining means is fed to a data storage means DS and the display DISPLAY. The information from the data storage means which is a RAM location is used to update the database DG and at the same time the information can be passed on to a radio transmitting means as seen in FIG. 4 to be received by other on board computers in other locomotives and other computers en route in structures such as stations, level crossing, station yards and so on or transmitted railway network management systems for continuously updating data in real time terms.

Figure 4:
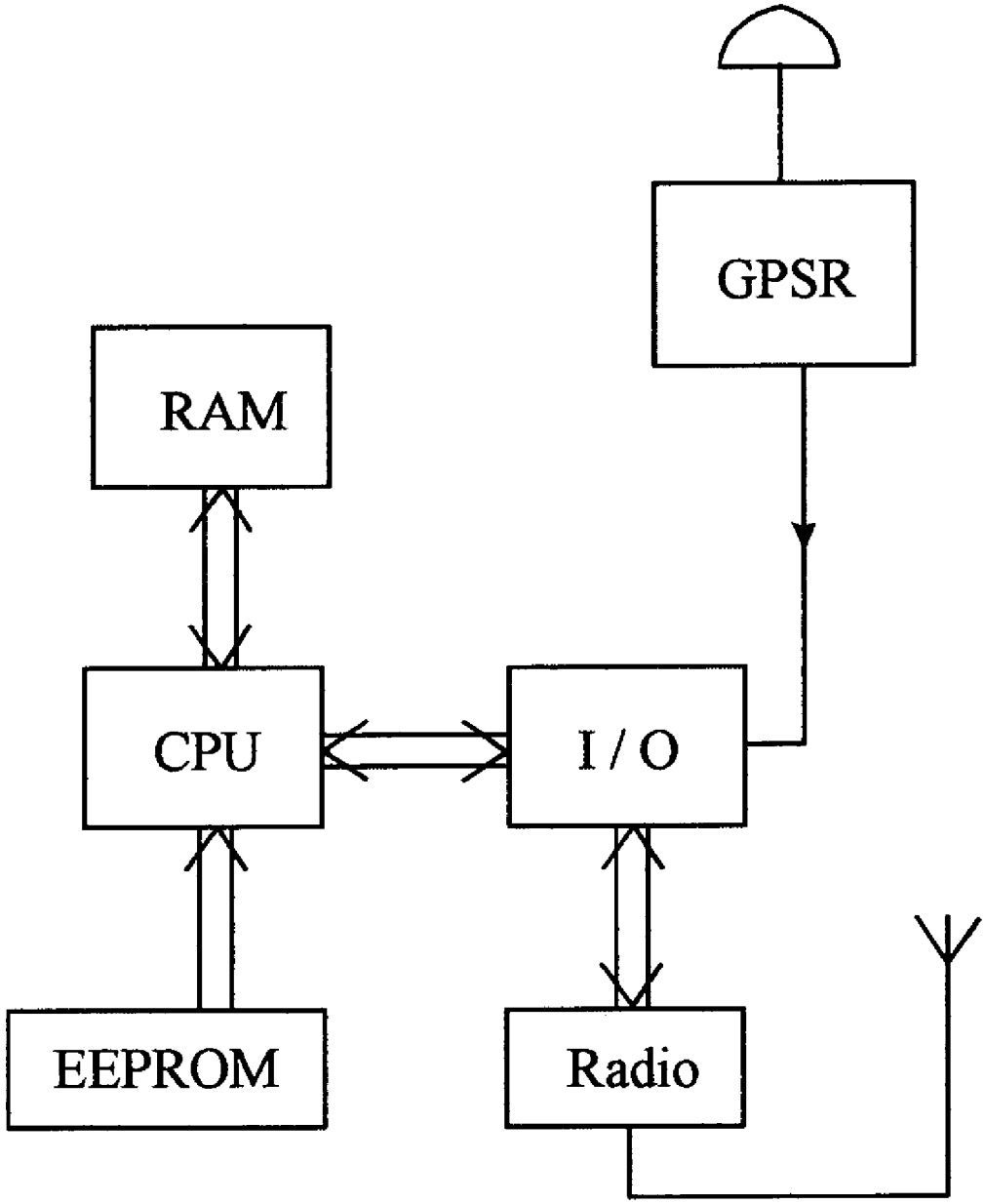
FIG. 4 is a typical application diagram of a practical embodiment of this invention.

Working of the Invention:

A typical application block diagram is seen in FIG. 4 of the accompanying drawings, wherein the external hardware for the on board computer CPU is shown. The on board computer CPU cooperates with the GPSR and the radio transmitter Radio via an input output devices I/O to transmit data in real time relating to the track identification of a running locomotive and its velocity. The on board computer draws information from the RAM and the EEPROM and information received by the CPU and processed therein is continuously updated in the CPU memory storage.

In order to detect the change in Track at a uniquely identifiable switching location where facility is provided to switch from one track to another the GPS receiver's course angle with respect to true north is used. The complete switching location area yard is converted to make a TID plan in which all lines are assigned a Track Identification Digit (TID) at each uniquely identifiable switching location point zone (the place where TID can change) is numbered and identified in terms of latitude and longitude. This complete data along with type of layout for each switching location is converted into a table called angular change profile table, which is fed in the processing means in each locomotive for each station area covered in the section. This data collection is done during GPS survey of the route/section to be implemented with a track identification system.

The Central processor in the on board computer receives GPS data at every second from the GPS receiver in NMEA protocol in RMC format, which includes latitude, longitude, speed, angle, time stamp. This angular profile data is validated and filtered using various algorithms to filter wrong or unwanted data. It is then averaged out typically using 5 point moving average method. The first difference is then calculated and stored when the on board computer finds that the locomotive L is in station area (defined in the data file through lat, lon). The cumulative first difference (CFD) is calculated when the on board computer CPU finds itself in a switching location (defined in data file) and the same is compared with the type of switching location and other parameters of that zone. In case it finds that as per the CFD value achieved in that zone, it has to change the TID, it remembers it as a change in the angular profile and changes the TID before exiting the zone. The station data file is loaded in the RAM for three stations viz Previous Station, Current Station and Next Station. The complete data of all the Stations enroute are loaded in the flash RAM, which can be updated whenever changes take place in the Station yard.

An example of the use of track identification system to avoid a Head on collision:

When a train with a track identification system in an onboard computer in accordance with this invention fitted thereto approaches another train with a similar on board computer and both trains are on the same the same track carrying the same TID, both the trains generate an Auto SOS condition to apply brakes to come to a stop. The on board computers transmits data packets in broadcasting mode at every 1 second or more as is predetermine under normal condition and at faster again as preset when either of them perceive a dangerous situation. This data packet contains self latitude, longitude, speed, TID, ID, status flags such as failure flag, auto SOS flag, side collision flag. When one train comes in a pre determined range such as 3000 m or more as set by the braking distance required, of another, its radio modem receives the data packet being broadcasted by other on board computer and vice-versa. The data is then sent to Central processor of both on board computers, which analyse it and in case they find that both trains have the same TID, the on board computer checks for approaching condition in the subsequent data from the same train. In case it finds that the other train is approaching, it acts to apply brakes based on the current speed, other train's speed, braking characteristics of the train and distance left between the two trains, such that it stops short of the other train with a sufficient safety margin. A network of similar identification systems can provide a safety shield for moving locomotives.

As can be understood by one skilled in the art the track identification system in accordance with this invention allows for determining and altering the track ID automatically without human intervention and only with the help of local intelligence without taking to recourse to central controls requiring a very broad communication band.

To ensure that there is no single point failure in the system, a minimum of two systems one in the front of the train and one at the rear at the guard to confirm the track Ids at both ends. This will avoid errors due to momentary loss of communication between the GPS antenna and the satellite for any reason in any one of the systems.

For additional confirmation the system can be designed to support further confirmation for track identification and changes in track from the station or stations associated with a switching location and receives this information via radio linkages. In case of any discrepancy between the track identification recorded by the system and the message received from the station, the system is designed to work in a fail safe mode and issue commands to reduce the speed of one or more locomotives. An automatic correction of the track identity takes place after the locomotive has exited the switching location area based on information received from the station controlling the switching location.

The invention claimed is:

1. A track identification system for a plurality of locomotives moving on a defined plurality of tracks, said tracks having uniquely identifiable switching locations wherein said locomotives can switch movement from one track to movement on to one or more other tracks, said tracks passing through a railway network comprising locomotives, stationary structures, and crossing yards, said system comprising on board computers fitted to each of the locomotives, said on board computers having storage means to eraseably storing digitally encoded information of at least a portion of the route and track data relating to said plurality of tracks, each of said uniquely identifiable switching locations, and the parameters of movement of the locomotives along said tracks, said on board computers having processors programmed to receive reference location signals of the locomotive from a global positioning system and thereby determine the precise geographical locations of the locomotives, said on board computers being further programmed to digitally map at least a portion of the determined geographical locations of the locomotives on the stored route and track data, and to continuously monitor the movement of the locomotives with reference to parameters at their switching locations, coordinates, velocity and angular change profile at said switching location, the system further comprising:

programming means that determine the angular change of the locomotive including during a time when the locomotive is switching from one track to another track at said switching locations based on said reference location signals and compare the determined angular changes on a continuous basis to derive an angular change profile in order to determine switching actions at the said switching locations and programmed signal generator means operable by said programming means to generate signals relative to the derived angular change profile relating to switching actions at the switching locations thereby determining the tracks on which the movement of each of the locomotives is occurring and the velocity of such movement.

2. A track identification system as claimed in claim 1, wherein the programming means includes means to determine a first difference angular change coupled with a second difference angular change to determine switching actions at said switching locations.

3. A track identification system as claimed in claim 1, wherein the system includes GPS antennas for receiving reference location signals from a GPS satellite said antennas cooperating with the on board computers.

4. A track identification system as claimed in claim 1, wherein the on board computers are powered through power sources independent of the power sources of the locomotives.

5. A track identification system as claimed in claim 1, wherein the on board computers have display means in which the determined track and the velocity of locomotive is displayed.

6. A track identification system as claimed in claim 1, wherein the on board computers are equipped with data storage means for storing the track changes at the switching locations.

7. A track identification system as claimed in claim 1, wherein the system includes transmitting means for transmitting the track changes to other locomotives and to stationary structures associated with railway network.

* * * * *